US006768424B1

(12) United States Patent
Morris

(10) Patent No.: US 6,768,424 B1
(45) Date of Patent: Jul. 27, 2004

(54) ENVIRONMENTAL CONDITION DETECTOR WITH REMOTE FIRE EXTINGUISHER LOCATOR SYSTEM

(76) Inventor: Gary J. Morris, 2026 Glenmark Ave., Morgantown, WV (US) 26505

( * ) Notice: Subject to any disclaimer, the term of this patent is extended or adjusted under 35 U.S.C. 154(b) by 0 days.

(21) Appl. No.: 09/487,064

(22) Filed: Jan. 19, 2000

Related U.S. Application Data

(60) Provisional application No. 60/116,636, filed on Jan. 21, 1999.

(51) Int. Cl.[7] ..... G08B 17/10

(52) U.S. Cl. ..... 340/628; 340/691.1; 340/693.6; 340/692; 340/539.1; 340/625; 340/584

(58) Field of Search ..... 340/628, 691.1, 340/693.6, 692, 539.1, 625, 584

(56) References Cited

U.S. PATENT DOCUMENTS

| | | | |
|---|---|---|---|
| 3,906,491 | A | 9/1975 | Gosswiller et al. |
| 4,101,872 | A | 7/1978 | Pappas |
| 4,141,007 | A | 2/1979 | Kavasilios et al. |
| 4,160,246 | A | 7/1979 | Martin et al. |
| 4,275,274 | A | 6/1981 | English |
| 4,282,519 | A | 8/1981 | Hagland et al. |
| 4,288,789 | A | 9/1981 | Molinick et al. |
| 4,335,379 | A | 6/1982 | Martin |
| 4,343,990 | A | 8/1982 | Ueda |
| 4,350,860 | A | 9/1982 | Ueda |
| 4,351,999 | A | 9/1982 | Nagamoto et al. |
| 4,363,031 | A | 12/1982 | Reinowitz |
| 4,365,315 | A | 12/1982 | Jamnik |
| 4,366,873 | A | 1/1983 | Levy et al. |

(List continued on next page.)

FOREIGN PATENT DOCUMENTS

WO WO/90/01759 2/1990

OTHER PUBLICATIONS

National Fire Protection Association, National Fire Alarm Code, Copyright 1996 NFPA, all rights reserved, NFPA 72, National Fire Alarm Code, 1996 Edition (partial copy, 72–1—72–106).

National Fire Protection Association, NFPA 720 Recommended Practice for the Installation of Household Carbon Monoxide (CO) Warning Equipment1998 Edition; copyright 1998 NFPA, All rights reserved, 1998 Edition.

Underwriters Laboratories Inc. (UL), UL 217 ISBN 0–7629–0062–8; Single and Multiple Station Smoke Alarms, Fifth Edition, copyright 1976, 1997 Underwriters Laboratories Inc.

Underwriters Laboratories Inc. (UL), UL 2034 ISBN 0–7629–274–9, Single and Multiple station Carbon Monoxide Alarms, Second Edition Oct. 29, 1996; Copyright 1992, 1998 Underwriters Laboratories Inc.

*Primary Examiner*—Daniel J. Wu
*Assistant Examiner*—Tai T. Nguyen
(74) *Attorney, Agent, or Firm*—Welsh & Katz, Ltd.

(57) ABSTRACT

A system for identifying the location of a fire extinguisher includes a fire detector with a wireless transmitter. When the detector goes into alarm, it not only emits a local audible alarm, it also transmits wirelessly a signal receivable by a fire extinguisher locating unit. This unit includes a receiver and circuitry for detecting the received alarm indicating signal. It also includes audible output circuitry, for example, speech synthesis circuitry, and optionally, an optical indicator. Upon detection at the unit of the alarm indicating signal, the speech synthesizing circuitry can be activated to indicate verbally the location of the extinguisher. Simultaneously, if desired, the illuminatable output device, such as a light bulb or light emitting diode, can be energized to provide a visual indication of extinguisher location.

30 Claims, 2 Drawing Sheets

U.S. PATENT DOCUMENTS 4,375,329 A 3/1983 Park
4,389,639 A 6/1983 Torii et al.
4,400,786 A 8/1983 Mandel et al.
4,453,222 A 6/1984 Goszyk
4,455,551 A 6/1984 Lemelson
4,481,507 A 11/1984 Takiguchi et al.
4,498,078 A 2/1985 Yoshimura et al.
4,500,971 A 2/1985 Futaki et al.
4,519,027 A 5/1985 Vogelsberg
4,531,114 A 7/1985 Topol et al.
4,560,978 A 12/1985 Lemelson
4,572,652 A 2/1986 Tada et al.
4,682,348 A 7/1987 Dawson et al.
4,688,021 A 8/1987 Buck et al.
4,698,619 A 10/1987 Loeb
4,737,771 A * 4/1988 Coash ..... 340/539
4,754,266 A 6/1988 Shand et al.
4,810,996 A 3/1989 Glen et al.
4,816,809 A 3/1989 Kim
4,821,027 A 4/1989 Mallory et al.
4,851,823 A 7/1989 Mori
4,862,147 A 8/1989 Thomas
4,894,642 A 1/1990 Ashbaugh et al.
4,940,965 A 7/1990 Umehara
4,951,045 A 8/1990 Knapp et al.
4,988,980 A 1/1991 Graham
5,016,715 A * 5/1991 Alasio ..... 169/61
5,019,805 A 5/1991 Curl et al.
5,103,206 A 4/1992 Yu
5,117,217 A 5/1992 Nykerk
5,148,148 A * 9/1992 Shima et al. ..... 340/539
5,153,567 A 10/1992 Chimento
5,166,664 A * 11/1992 Fish ..... 340/539
5,229,753 A 7/1993 Berg et al.
5,291,183 A 3/1994 Chiang
5,349,338 A 9/1994 Routman et al.
5,379,028 A 1/1995 Chung
5,460,228 A 10/1995 Butler
5,506,565 A 4/1996 Andrew De Leon et al.
5,548,276 A 8/1996 Thomas
5,587,705 A 12/1996 Morris
5,594,417 A * 1/1997 Morita ..... 340/506
5,657,380 A 8/1997 Mozer
5,663,714 A 9/1997 Fray
5,673,023 A 9/1997 Smith
5,686,885 A * 11/1997 Bergman ..... 340/514
5,724,020 A 3/1998 Hsu
5,726,629 A 3/1998 Yu
5,745,040 A * 4/1998 Loughridge ..... 340/628
5,764,134 A 6/1998 Carr et al.
5,786,749 A 7/1998 Johnson et al.
5,786,768 A 7/1998 Chan et al.
5,793,280 A 8/1998 Hincher
5,798,686 A 8/1998 Schreiner
5,841,347 A 11/1998 Kim
5,846,089 A 12/1998 Weiss et al.
5,848,651 A * 12/1998 McSheffrey et al. ..... 169/51
5,856,781 A 1/1999 Michel et al.
5,864,288 A 1/1999 Hogan
5,874,893 A 2/1999 Ford
5,877,698 A 3/1999 Kusnier et al.
5,886,631 A 3/1999 Ralph
5,894,275 A 4/1999 Swingle
5,898,369 A 4/1999 Godwin
5,905,438 A 5/1999 Weiss et al.
5,914,650 A 6/1999 Segan
5,936,515 A 8/1999 Right et al.
5,949,332 A * 9/1999 Kim ..... 340/539
5,952,919 A * 9/1999 Merrill ..... 340/539
5,986,540 A 11/1999 Nakagaki et al.
6,043,750 A 3/2000 Mallory
6,114,967 A 9/2000 Yousif
6,124,796 A * 9/2000 Hincher ..... 340/628
6,133,839 A 10/2000 Ellul et al.

* cited by examiner

ENVIRONMENTAL CONDITION DETECTOR WITH REMOTE FIRE EXTINGUISHER LOCATOR SYSTEM

The benefit of the filing date of Jan. 21, 1999 of Provisional Application No. 60/116,636 is hereby claimed.

FIELD OF THE INVENTION

The invention pertains to fire alarm systems. More particularly, the invention pertains to apparatus and methods of locating fire extinguishers in the event of a fire.

BACKGROUND FOR THE INVENTION

During the occurrence of a fire, the occupants of the involved dwelling may need to quickly access a fire extinguisher to extinguish the fire. The occupants may not know or remember the location of an available fire extinguisher, particularly in an emotionally stressful situation with an alarming smoke or fire detector and the presence of smoke and flames.

A need exists for a fire safety system whereby a detector sensing smoke or fire not only sounds the conventional audible alarm, but also serves to activate an audible location identifier (a distinctive audible alarm or recorded verbal location identifier) that is fixed to a portable fire extinguisher or its mounting hardware. In this way, the location of a nearby fire extinguisher is made known to the occupant(s) of the involved building.

U.S. Pat. No. 5,153,567 (Expired) describes a hardwired system whereby a fire extinguisher housing contains a smoke alarm and flashing light. Other related prior art known to the inventor is the U.S. Pat. No. 5 ,587,705 solely owned by the present inventor, and which describes radio frequency links between environmental condition detectors and remote, emergency lighting systems. U.S. Pat. No. 5,793,280 describes a beacon that is located on a fire extinguisher bracket such that the beacon is activated by the presence of motion in close proximity to the bracket.

SUMMARY OF THE INVENTION

The invention described herein is a fire safety system whereby the occupants of a building are immediately notified of the location of fire extinguishers in close proximity. An audible alarm or verbal location identifier is activated by a remotely located, displaced, environmental condition detector (smoke detector, fire detector or heat detector).

In one embodiment, a fire detector is wirelessly coupled to a local extinguisher. When the detector senses an environmental condition such as smoke, fire, or heat it sounds its conventional audible alarm and also sends a signal to cause a remotely located fire extinguisher(s) to sound an audible alarm or verbal location identifier (for example a verbal "Fire Extinguisher") or both. Occupants can as a result, quickly locate the fire extinguisher.

The communication link between the detector and the remotely located fire extinguisher(s) can be wireless (radio frequency, audio frequency or infrared). Alternately, the link can be hardwired. In yet another embodiment, both types of links can be used.

The audible tone/voice emitter electronic circuitry located at the fire extinguisher may be mounted directly to the fire extinguisher or the mounting hardware for the extinguisher. The circuitry may be positioned adjacent to the extinguisher.

As an alternate embodiment, a battery-powered light may be included along with the local alarm or verbal location identifier to facilitate finding the fire extinguisher in the dark. The battery powered light component activates along with the fire extinguisher alarm locator and/or verbal location identifier.

The wireless communication receiver located on the fire extinguisher or mounting hardware can be battery operated to afford portability or may be 120VAC powered in another embodiment. The detector, a smoke, flame or heat detector can be battery powered or powered by 120VAC. The detector need only have the capability to detect one environmental condition (smoke or fire or excessive heat) within an adjacent region.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENT

Figure 1:
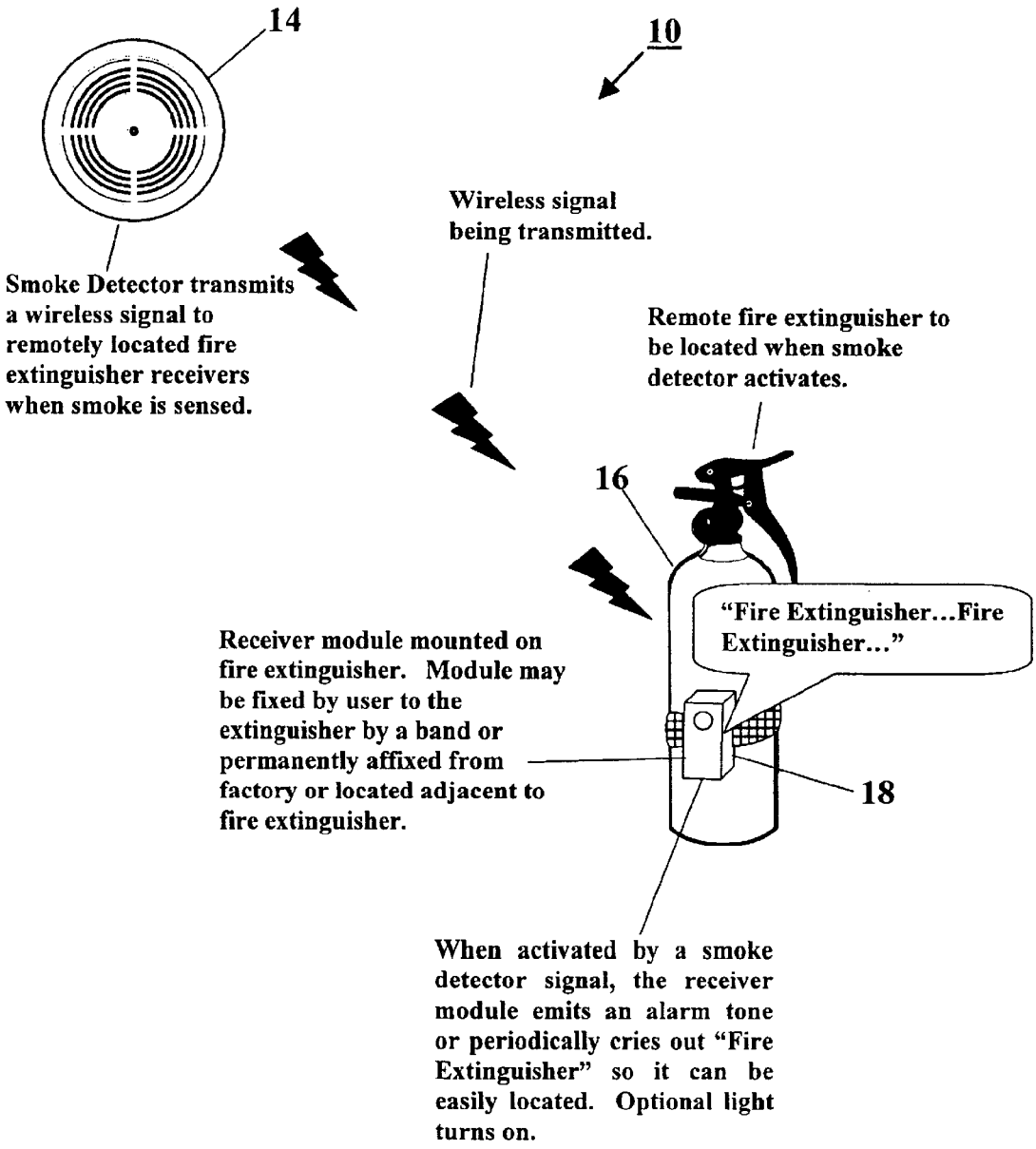
FIG. 1 is an overall view of an extinguisher locator system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

As illustrated in FIG. 1, a preferred embodiment, a system 10 includes an environmental condition detector (smoke detector, fire detector or heat detector, as separate embodiments) 14 and a fire extinguisher 16. An output unit, receiver module 18 can be attached to or associated with extinguisher 16.

Figure 2:
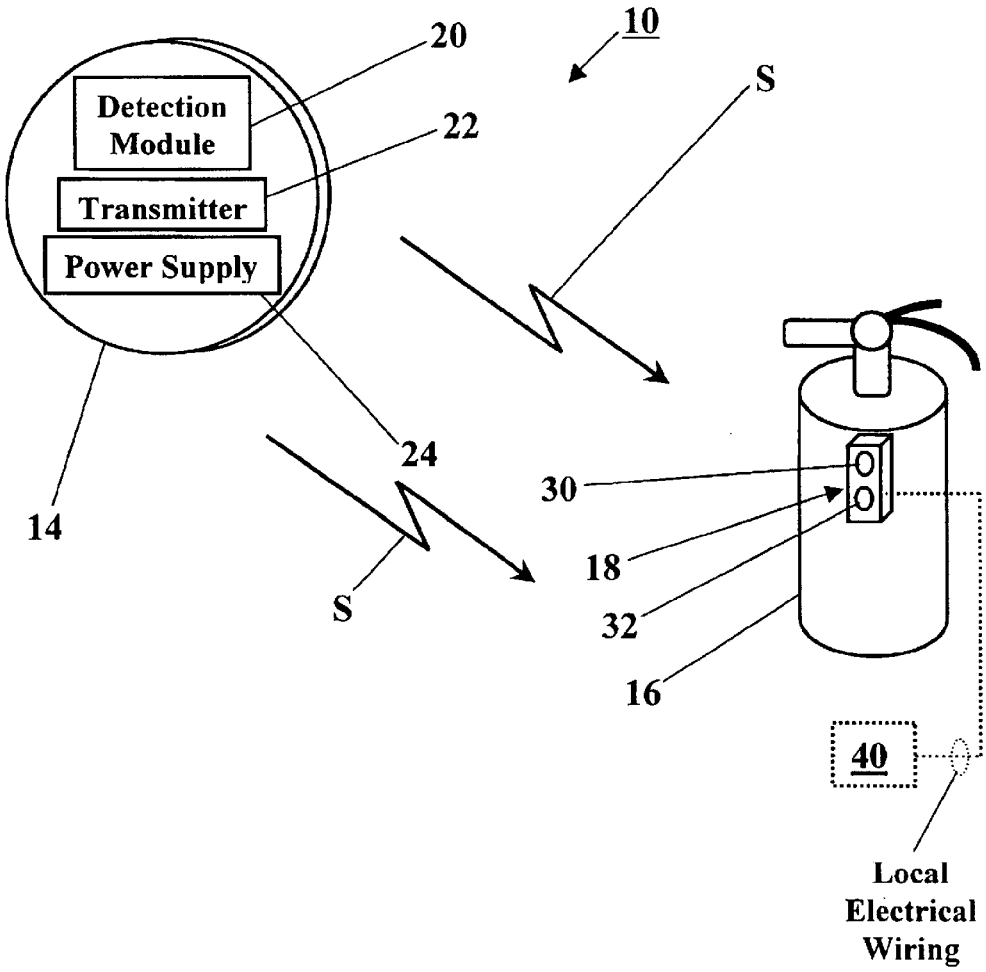
FIG. 2 is a more detailed drawing of the extinguisher locator system of FIG. 1.

With respect to FIG. 2, the detector 14 includes a smoke, fire, or heat detection module 20, a wireless transmitter 22, and a power supply 24. Upon detection of smoke, fire, or heat in the immediate area, the detection module 20 sounds its included audible alarm and activates the wireless transmitter 22. A wireless signal (radio frequency, audio frequency or optical) S is transmitted from the detector 14. The detector power supply 24 includes battery(s) and/or 120VAC power as are well known in the art.

The fire extinguisher receiver module 18, receives, decodes, and validates the wireless signal S. Upon validation of a transmitted wireless signal S, the receiver module 18 activates an audible alarm and/or a periodic audible verbal location circuit 30. The circuit 30 includes stored digital phrases, such as "Fire Extinguisher".

When circuit 30 is activated, a stored phrase such as "Fire Extinguisher" is audibly stated such that the location of fire extinguisher unit 16 may be quickly identified. A lamp 32 can optionally be included and illuminated to further assist in the location of the fire extinguisher unit 16, especially in a dark environment.

The wireless signal S is transmitted for the duration of the environmental condition detected by the detector module 20. The fire extinguisher receiver unit 18, and all of its electrical components can be battery operated. This provides flexibility in locating the fire extinguisher unit 18. Alternately, unit 18 may be 120VAC powered with or without battery backup.

Unit 18 can be attached to extinguisher 16. Alternately, unit 18 can be placed on the floor or wall adjacent to extinguisher 16.

In an alternate embodiment, detector 14 and extinguisher 18 can be hardwired to one another. In yet another embodiment, detector 14 can wirelessly transmit to a plug-in module 40, illustrated in phantom. Module 40 can in turn be coupled to unit 18 using a wired medium, for example the local electrical wiring.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An apparatus to identify the location of a displaced fire extinguisher comprising:

a detector for detecting the presence of fire in a region, wherein the detector includes electronic circuitry including an audible alarm indicating output device and a wireless transmitter wherein the device and the transmitter are activated to emit respectively an audible alarm and a wireless signal for the duration of the condition detected by the detector; and a displaced wireless signal receiver independently positionable relative to the detector capable of receiving and decoding the wireless signal from the detector wherein the wireless receiver includes circuitry to activate one of an audible alarm or a recorded verbal location identifier at the location of the fire extinguisher to facilitate location thereof the receiver is carried in a portable housing which also carries an emergency light.

2. An apparatus as in claim 1 wherein the wireless transmitter outputs one of a radio frequency signal, an acoustic signal and an optical signal.

3. An apparatus as in claim 1 wherein the receiver includes speech synthesizing circuitry.

4. An apparatus as in claim 3 wherein the synthesizing circuitry includes a pre-stored extinguisher identifying indicium which is audibly output by the synthesizing circuitry when activated.

5. An apparatus to activate a battery operated light in response to a detected condition comprising:

an environmental condition detector which includes a wireless transmitter activated to transmit a selected signal for the duration of the environmental condition detected by said detector;

a portable fire extinguisher, remotely located relative to the detector and movable relative thereto at least when the detector is in a quiescent state; and a wireless signal receiver, adjacent to or coupled to the extinguisher and capable of receiving and decoding the selected signal from the detector, wherein the receiver includes an electric light and a pre-estabilshed verbal location identifier; and circuitry to activate the light to facilitate location identification of the fire extinguisher and to provide an emergency flashlight separable from the extinguisher.

6. An apparatus as in claim 5 wherein the receiver is carried in a housing located in the vicinity of the extinguisher.

7. An apparatus as in claim 5 whereby the receiver is attached to the extinguisher.

8. An alarm system comprising:

a fire detector which includes a housing which carries at least an audible alarm indicating output device and a wireless transmitter of alarm indicating indicia wherein both audible output device and the transmitter are activated in response to a detected fire; and a non-electrified fire extinguisher positionable independently of and displaced from the detector wherein the extinguisher has associated therewith a wireless receiver of the transmitted alarm indicating indicia and an extinguisher location indicating output device whereby in response to received alarm indicating indicia the output device outputs at least one of a visible extinguisher location indicator and a pre-established verbal extinguisher location indicator.

9. A system as in claim 8 wherein the output device comprises at least one of a speech output circuit, a tonal output circuit and a visible light output circuit.

10. A system as in claim 8 wherein the wireless receiver is coupled to an extinguisher connection element the receiver carrying a portable electric light.

11. An apparatus comprising:

an ambient condition detector;

a portable non-electrified fire extinguisher, movably locatable apart from the detector, whereby the detector can be located at one position and the extinguisher can be separately located at a different position and subsequently moved relative thereto when both are in a quiescent state;

a self-contained voice output module located at one of, on or adjacent to the extinguisher, wherein the module includes a wireless receiver for receiving an alarm indicating signal directly from the detector and circuitry coupled thereto, responsive to the received signal for emitting a pre-established verbal extinguisher locating message.

12. An apparatus as in claim 11 wherein the module carries an attachment member for coupling the module to the extinguisher.

13. An apparatus as in claim 12 wherein the attachment member removably couples the module to the extinguisher the module carries an emergency light.

14. An apparatus as in claim 12 wherein the attachment member comprises a flexible strap.

15. A module attachable to a fire extinguisher comprising:

an attachment element, couplable to the extinguisher;

a housing carried by the attachment element, the housing is electrically isolated from the extinguisher;

a wireless receiver of remotely generated fire alarm indicating signals carried by the housing; and circuitry coupled to the receiver, responsive only to received alarm indicating signals, for emitting at least one verbal extinguisher position locating message.

16. A module as in claim 15 wherein the attachment element is releasibly couplable to the extinguisher.

17. A module as in claim 15 wherein the circuitry includes digital storage for the verbal message.

18. A module as in claim 15 wherein the circuitry comprises speech synthesizer circuitry for continuously emitting at least one verbal, extinguisher locating message in response to received fire alarm indicating signals.

19. A module as in claim 18 which includes a visual output device and circuitry for energizing the output device in response to received fire alarm indicating signals.

20. A module as in claim 15 which includes a visual output device and circuitry for energizing the output device in response to received fire alarm indicating signals.

21. An alarm system comprising:

at least one fire detector which includes components for emitting an audible fire alarm and an inaudible fire alarm signal;

a displaced module, couplable to a fire extinguisher, wherein the module includes a wireless receiver of remotely generated, inaudible fire alarm indicating signals; and circuitry coupled to the receiver responsive to received inaudible alarm indicating signals, for emitting a pre-established verbal extinguisher indicating indicium; the module, the receiver and the circuitry are all electrically isolated from the extinguisher.

22. An alarm system as in claim 21 wherein the module includes a releasible attachment element for coupling to the extinguisher.

23. An alarm system as in claim 21 wherein the inaudible alarm signal comprises a wireless signal.

24. An alarm system as in claim 21 wherein the inaudible alarm signal comprises, at least in part, a wired signal coupled by AC electrical power wiring to the module.

25. An alarm system as in claim 24 wherein the module includes an AC line plug for engaging AC electrical power wiring.

26. An apparatus to identify the location of a displaced fire extinguisher comprising:

a detector for detecting the presence of fire in a region, wherein the detector includes electronic circuitry including an audible alarm indicating output device and a transmitter of an alarm indicating signal, wherein the device and the transmitter are activated to emit respectively an audible alarm and the alarm indicating signal for the duration of the condition detected by the detector; and a displaced signal receiver independently positionable relative to the detector, capable of receiving and decoding the alarm indicating signal from the detector wherein the receiver is removably attachable to an extinguisher to be identified and electrically isolated therefrom, the receiver includes circuitry to activate one of an audible alarm or a recorded verbal location identifier at the location of the fire extinguisher to facilitate location thereof.

27. An apparatus as in claim 26 where the receiver covers less than fifty percent of the surface area of the extinguisher, when attached thereto.

28. An apparatus as in claim 27 where the receiver includes a battery powered light, the receiver and light can be separated from the extinguisher and used as a portable emergency flashlight, displayed from the extinguisher.

29. An alarm system comprising:

a fire detector which includes a housing which carries at least an audible alarm indicating output device and a transmitter of alarm indicating indicia wherein both audible output device and the transmitter are activated in response to a detected fire; and a non-electrified fire extinguisher positionable independently of and displaced from the detector wherein the extinguisher has a housing removably attached thereto, the housing carries both a receiver of the transmitted alarm indicating indicia and an extinguisher location indicating output device whereby in response to received alarm indicating indicia the output device outputs at least one of a visible extinguisher location indicator and a predetermined verbal extinguisher location indicator, the housing is small relative to the extinguisher and the extinguisher can be used in an emergency even with the housing attached.

30. A system as in claim 29 wherein the output device comprises at least one of a speech output circuit, a tonal output circuit and a visible light output circuit.

* * * * *